US006827070B2

(12) United States Patent
Fehl et al.

(10) Patent No.: US 6,827,070 B2
(45) Date of Patent: Dec. 7, 2004

(54) METHOD AND DEVICE FOR CONTROLLING AN ENGINE

(75) Inventors: Gerhard Fehl, Stuttgart (DE); Winfried Langer, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 80 days.

(21) Appl. No.: 10/406,887

(22) Filed: Apr. 4, 2003

(65) Prior Publication Data

US 2003/0213465 A1 Nov. 20, 2003

(30) Foreign Application Priority Data

Apr. 8, 2002 (DE) ..... 102 15 406

(51) Int. Cl.[7] ..... F02D 41/18
(52) U.S. Cl. ..... 123/682; 123/683; 123/690
(58) Field of Search ..... 123/399, 682, 123/683, 690

(56) References Cited

U.S. PATENT DOCUMENTS 5,293,852 A * 3/1994 Lehner et al. ..... 123/399
6,295,967 B1 * 10/2001 Weber et al. ..... 123/399
6,357,419 B1 * 3/2002 Langer et al. ..... 123/690
6,615,812 B2 * 9/2003 Wild et al. ..... 123/683
6,735,938 B2 * 5/2004 Surnilla ..... 123/399
2003/0075147 A1 * 4/2003 Kowatari et al. ..... 123/399
2003/0209236 A1 * 11/2003 Kirschke et al. ..... 123/690

FOREIGN PATENT DOCUMENTS

DE 199 00 740 7/2000

* cited by examiner

*Primary Examiner*—Erick Solis
(74) *Attorney, Agent, or Firm*—Kenyon & Kenyon

(57) ABSTRACT

A method and a device for controlling an engine, in which a control module calculates a setpoint torque based on an accelerator position and calculates an air mass and a fuel mass from this setpoint torque. In the process, a setpoint value for lambda (ratio of air mass to fuel mass) is taken into account when the fuel mass is calculated. A monitoring module calculates a monitoring value for the air mass from the fuel mass and compares it to a measured air mass for fault detection.

10 Claims, 3 Drawing Sheets

METHOD AND DEVICE FOR CONTROLLING AN ENGINE

BACKGROUND INFORMATION

From German Patent No. DE 199 00 740, a method for controlling an engine is known in which the correct functioning is monitored as well. In the process, it is checked whether the signal from a lambda probe, i.e. a probe representing the oxygen concentration of the exhaust gas of the internal combustion engine, exceeds a predefined limiting value. Such limiting values are to be controlled especially when a lean air/fuel mixture is given.

SUMMARY OF THE INVENTION

The method according to the present invention and the device according to the present invention have the advantage that a monitoring of the correct functioning is possible even in the case of internal combustion engines which have no sensor for determining lean operating states. Therefore, the method and the device according to the present invention may be uniformly used both for engines that are continuously operated at lambda=1, and for engines in which a deviation from a value of lambda=1 is possible in certain operating states. The present invention ensures that one and the same monitoring of the correct functioning is made possible in a uniform manner for both types of engines, thereby allowing uniform use of the present invention for different engine concepts.

The present invention, in particular, is able to be utilized in a useful manner in engines in which the injected fuel quantity is controlled to a lambda setpoint value, especially in engines in which the lambda setpoint value is controlled to 1. Further influencing factors, such as fuel tank venting or a transition compensation, may be taken into account for calculating the fuel quantity. Additional checks can increase this functional reliability even further. In particular, the calculated control (triggering) time for a fuel injector may be compared to the fuel quantity, thereby ensuring that the control time for the fuel injector is calculated correctly. By comparing a first torque directly calculated from the position of the accelerator pedal, to a torque calculated from the fuel quantity it is possible to determine whether the fuel quantity has been calculated correctly. A further fault check may be performed by comparing a correction value, which is used to convert a setpoint torque into a fuel quantity, to a comparison value. Only predefined deviations from the comparison value are permitted in this context.

DETAILED DESCRIPTION

Figure 1:
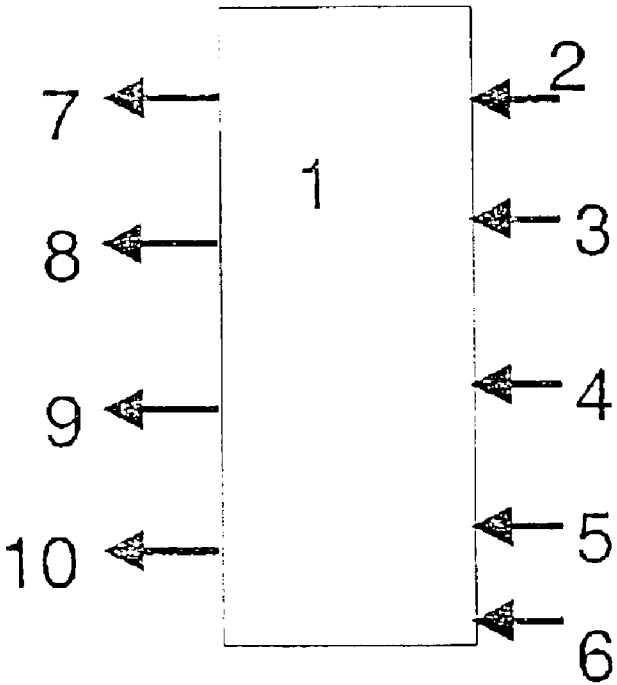
FIGS. 1 and 2 schematically show control devices for controlling an internal combustion engine.

FIG. 1 schematically shows an external view of a control device 1. Control device 1 has a plurality of inputs 2 through 6 and a plurality of outputs 7 through 10. Present at input 2, for instance, is the signal of an accelerator sensor, i.e., a signal providing information about the position of an accelerator (accelerator pedal). At input 3, the signal of a mass flow sensor is present, i.e., a sensor representing a measure of the air mass supplied to the engine. At input 4, the signal from a lambda probe is available, i.e., a probe providing information about the oxygen content of the exhaust gas.

Such probes are extremely precise at a lambda value=1, that is, in an operating state in which the supplied air quantity is in a stoichiometric relationship to the supplied fuel quantity. At input 6, a sensor signal is available from which the rotational speed of the internal combustion engine may be determined. Input 6 stands here more schematically for a multitude of additional inputs, such as for engine temperature, angle a of the throttle valve, and the like.

At output 7 of control device 1 an actuating signal for the throttle valve, for instance, is output. At output 8 of the control device, a control signal for a fuel injector is output, for example. This may be a square-wave signal, the duration of the square-wave signal corresponding to the control time of the fuel injector. At output 9, ignition signals, that is, for controlling the ignition output stages, may be output. Output 10 stands for additional output signals which are either direct control signals or else are signals that are output via a bus, such as the CAN bus. Internally, control device 1, not shown here, includes a computer memory and appropriate input or output circuits.

Figure 2:
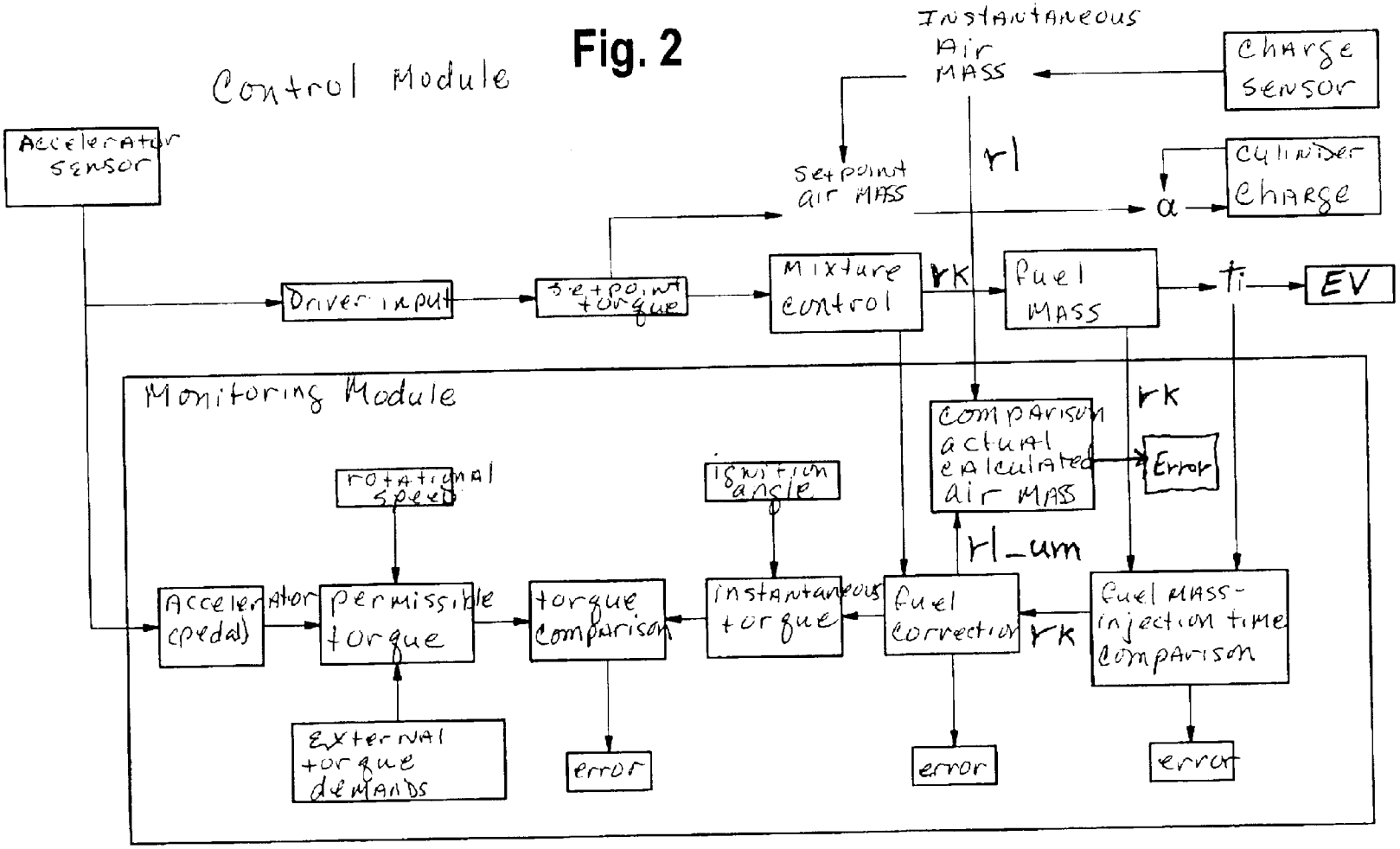

A program whose basic design is shown in FIG. 2 runs in the computer.

FIG. 2 schematically shows the interaction of different parts of the program of the control computer. The program for the control has two modules, namely a control module and a monitoring module. However, both modules are realized in one software and are processed by one and the same computer. Referred to as control module in this context is the part of the program that performs the actual control functions of the internal combustion engine. The monitoring module is the part of the program that assumes the monitoring of the control module. The control module is described first. Based on a signal from an accelerator sensor, a driver input, and a setpoint torque resulting therefrom, are determined. A setpoint air mass, i.e., the air quantity to be provided to the internal combustion engine, is then determined from the setpoint torque. From the setpoint air mass, an angle a for the throttle valve is then established. This angle a is transmitted to a cylinder-charge control, i.e., to an element actuating the throttle valve accordingly. This cylinder charge control provides back a measured angle for the throttle valve, as shown by the arrow pointing from the cylinder-charge control to angle $\alpha$. In this case, it is a small closed loop control by which it is ensured that the cylinder-charge control is indeed realizing the desired angle a. Moreover, a charge sensor is provided, i.e., a sensor permitting a statement to be made about an actually attained air supply to the internal combustion engine. This may be, for instance, a mass flow sensor and/or a pressure sensor in the intake tract. From the signal of the charge sensor, an actual air mass is determined, i.e., a measured signal indicating the air mass supplied to the internal combustion engine. This signal is also considered when calculating the setpoint air mass.

Furthermore, the mixture control calculates a fuel mass from the setpoint torque. In doing so, the mixture control takes various influencing variables into account. In an internal combustion engine in which the fuel is injected into the suction manifold, a lambda value of 1 (stoichiometric mixture) is normally desired. Toward this goal, an appropriate lambda sensor, which is most precise in the range of lambda=1, i.e., in stoichiometric operation, transmits a corresponding lambda signal to the mixture control. On the basis of this lambda signal, a regulation then takes place to the effect that the lambda value is regulated to 1, i.e., corresponding setpoint selections from the setpoint torque are converted into a corresponding value for the fuel mass, this value ensuring a lambda signal of 1. In an internal combustion engine in which the fuel is directly injected into the cylinder, it is also possible to provide operating states in which the lambda value is not controlled to 1, but in which different lambda values are realized by appropriate setpoint selections. In particular, it is possible to realize lean operating states in which an excess of air is present and the actual output generated by the engine is essentially limited by the fuel quantity. In this case, the lambda value is not controlled, since the accuracy of the appropriate lambda sensors in ranges deviating from 1 is insufficient for control. A control is then implemented in the sense that an appropriate fuel quantity is calculated for realizing the setpoint torque. In such an operating state, a sufficient quantity of air for the combustion of the fuel is always available, so that the setpoint torque is controlled exclusively by the injected fuel quantity. Based on the fuel quantity thus determined, a control (triggering) duration ti for fuel injectors EV is calculated in a subsequent step, which is output correspondingly.

The control module is monitored in the monitoring module. A first comparison is performed in the comparison fuel-quantity/injection-time functional block, the calculated fuel mass being fed to this functional block. Furthermore, calculated injection time ti is fed to this functional block. In the comparison fuel-quantity/injection-time functional block, supplied injection time ti is calculated back into a fuel mass and then compared to the fuel mass calculated by the mixture control. These two values for the fuel mass should be identical within a narrow tolerance range. If this is not the case, a fault signal is generated, which leads to appropriate safety measures.

Comparison-fuel-mass/injection-time functional block forwards the read-in value for the fuel mass calculated by the mixture control to the fuel-correction functional block. Moreover, a plurality of values of the mixture control are fed to the fuel correction. These values are conversion factors for how to calculate a corresponding fuel quantity from the setpoint torque. For instance, this may be a contribution by lambda control for the stoichiometric operation around lambda=1. Moreover, additional other factors, such as an acceleration enrichment, warm-up enrichment etc. may be considered there as well. Each of these factors is compared to individual threshold values since these influencing factors must not exceed certain values. If these threshold values are exceeded, another fault signal is generated correspondingly.

In addition, based on the fuel mass the comparison-fuel-mass/injection-time functional block has forwarded, the fuel-correction functional block calculates an air-mass signal as well. This air-mass signal is fed to the comparison-instantaneously-calculated-air-mass block. Moreover, the measured air-mass signal instantaneous-air-quantity is fed to this functional block. In the comparison-actual-calculated-air mass block, the instantaneous air mass determined from the sensor signal is compared to the air mass calculated by the fuel correction. Thus, a comparison of a calculated air mass (from the fuel correction) with an actually measured air mass (instantaneous air mass) takes place. This means that the calculated fuel mass is checked for plausibility against the measured air mass, only narrow deviations within a tolerance range being permitted between these two values. If the deviation is too substantial, a fault signal is generated again. Therefore, by this comparison, the fuel quantity calculated by the control module is checked for plausibility in relation to the measured air mass. This makes it possible to check the entire calculation of the fuel mass for plausibility in a simple manner, and faults are easily detected. However, in the calculation of the air mass from the fuel mass, the fuel correction must take possible deviations from lambda 1 into account. Of course, if a very lean mixture is adjusted by the mixture control of the control module, a substantially higher air mass relative to the fuel mass must be calculated than would be the case in lambda=1. Only then is it ensured that, for the comparison with the measured air mass, the air mass calculated by the fuel correction is able to actually correspond to the measured air mass.

However, the comparison between the measured air mass and the air mass calculated from the fuel mass is not useful in the case of an overrun fuel cut-off. For in this operating state the fuel mass is set to zero by the control module, so that a corresponding air-mass signal calculated therefrom is zero as well. However, air continues to be supplied to the engine, that is, the measured air mass is not equal to zero. In order not to provoke a fault report in this case, a corresponding fault report must be suppressed when overrun conditions prevail. Correspondingly, the operational case of individual cylinders being switched off in which individual cylinders are not supplied with fuel must also be considered.

The fuel correction calculates still another air-mass signal, which is utilized to calculate the instantaneous torque. The fuel calculation transmits a corresponding air-mass signal to the following instantaneous-torque functional block. In this calculation, too, appropriate lambda setpoint selections of the mixture control have to be taken into account. As long as lambda=1 or >1, a corresponding air mass is calculated from the fuel quantity through the direct use of the value lambda=1. The reason for this is that in the case of excess air and a stoichiometric air/fuel mixture, a corresponding torque is determined exclusively by the quantity of the available fuel. However, in an operation where lambda is substantially below 1, a corresponding torque is limited by the quantity of the available air, i.e., the fuel calculation must take a corresponding lambda value below 1 into account when calculating the air mass for the instantaneous-torque functional block. From the air-mass signal thus determined, the instantaneous-torque functional block then calculates an instantaneous torque, which is fed to the torque-comparison functional block. Moreover, based on the signal from the accelerator, taking into account the rotational speed and external torque demands of auxiliary units, a permissible torque is calculated, which is then likewise fed to the torque-comparison functional block. A comparison of the thus ascertained permissible torque with the calculated instantaneous torque is then performed. It is essential in this context that the permissible torque has been calculated from the signal of the accelerator sensor, i.e., the value representing an input for the control module as well. On the other hand, the instantaneous torque had been calculated from the output values of the control module. Therefore, comparing these two torques supplies a plausibility check of the entire calculation of the engine control signals. For the torque comparison, it is sufficient here to ensure that the instantaneous torque is lower than the permissible torque since an uncontrolled increase in the torque may lead to dangerous driving conditions of a motor vehicle operated by an internal combustion engine.

Figure 3:
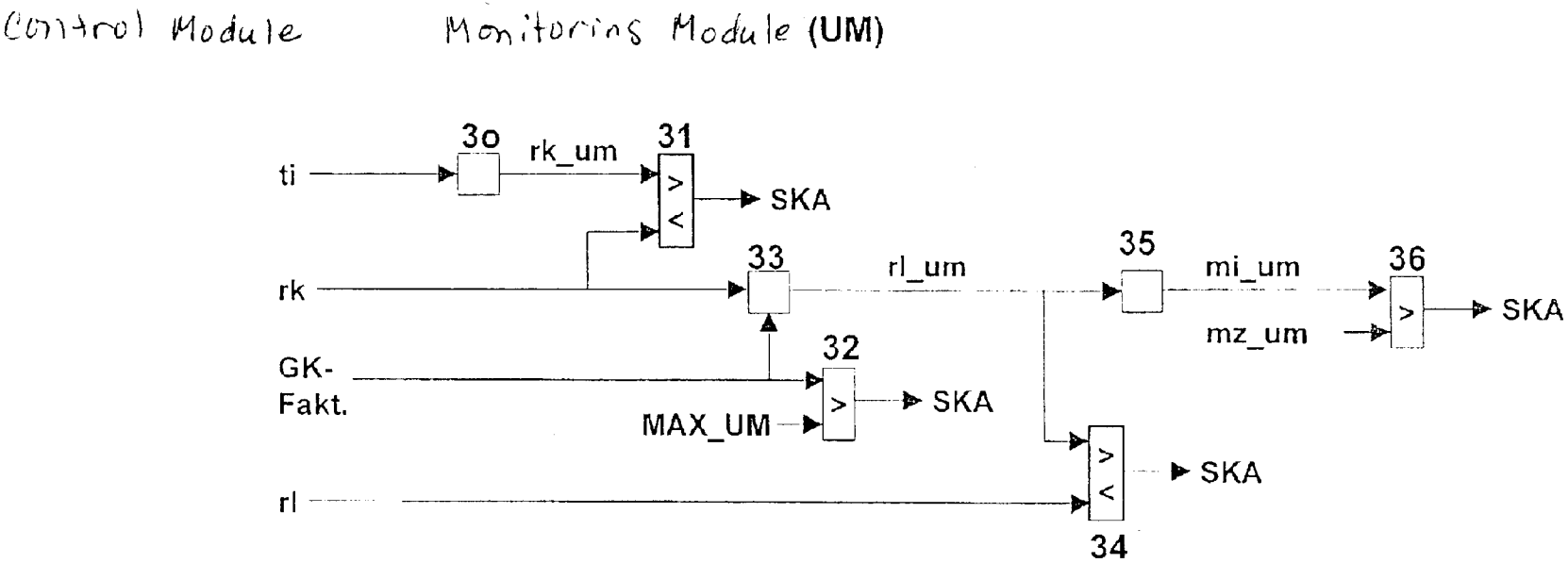
FIG. 3 shows a flow chart of the monitoring module.

In FIG. 3, the sequence of the monitoring program is shown once again in a schematic representation. As input variables, the monitoring module (UM=monitoring module) is provided with a number of variables of the control module. In this context, ti stands for the control time of the fuel injector; rk for the calculated fuel mass, GK_FAKT stands for the conversion factors of the mixture control with the aid of which the value rk is calculated based on the setpoint torque; and rl stands for the measured air mass. In the monitoring module, in a conversion step 30, a fuel quantity rk_um is calculated from ti which is then compared in comparison block 31 to value rk. In the case of deviations that are too substantial, i.e., too great or too low, a safety fuel switch-off (SKA) is triggered as a response to the fault. In the monitoring module, in a comparison block 32, the GK-factors are compared to threshold values max_UM. If the GK-factors exceed these values, a safety fuel switch-off is triggered again in response to a fault. The GK-factors are also taken into account in a calculation block 33 to convert the calculated fuel mass of the control module into corresponding air-mass values rl_um of the monitoring module. The values rl_um calculated in this manner are then compared to the measured values rl of the control module. In the case of deviations that are too substantial (greater or smaller), a safety fuel shut-off is triggered again. In functional block 35, the value rl_um is then converted into instantaneous torque mi_um, which is compared in comparison block 36 to the permissible torque mz_um. If the instantaneous torque exceeds the permissible torque to an intolerable degree, a safety fuel shut-off is triggered again.

What is claimed is:

1. A method for controlling an engine comprising:

calculating, using a control module, a setpoint torque as a function of an accelerator position;

calculating, using the control module, an air mas and a fuel mass as a function of the setpoint torque, the fuel mass being calculated as a further function of a setpoint value for an air-mass-to-fuel-mass ratio (lambda);

calculating, using a monitoring module, a monitoring value for the air mass as a function of the fuel mass; and comparing, using the monitoring module, the monitoring value for the air mass to a measured air mass for fault detection.

2. The method according to claim 1, further comprising, using the monitoring module:

calculating a permissible torque as a function of the accelerator position;

calculating an instantaneous torque as a function of the fuel mass; and comparing the permissible torque and the instantaneous torque to one another for fault detection.

3. The method according to claim 1, further comprising:

calculating a control time for a fuel injector as a function of the fuel mass; and checking, using the monitoring module, the fuel mass and the control time for the fuel injector for plausibility relative to one another.

4. The method according to claim 2, wherein, to calculate the fuel mass, the control module considers correction factors, the correction factors being compared to threshold values for fault detection.

5. The method according to claim 4, wherein, to calculate the instantaneous torque, the correction factors are taken into account.

6. A device for controlling an engine comprising:

a control module for calculating a setpoint torque as a function of an accelerator position and for calculating an air mass and a fuel mass as a function of the setpoint torque, the fuel mass being calculated as a further function of a setpoint value for an air-mass-to-fuel-mass ratio (lambda); and a monitoring module for calculating a monitoring value for the air mass as a function of the fuel mass and for comparing the monitoring value for the air mass to a measured air mass for fault detection.

7. The device according to claim 6, wherein the monitoring module calculates a permissible torque based on the accelerator position and calculates an instantaneous torque based on the fuel mass and compares the permissible torque and the instantaneous torque to one another for fault detection.

8. The device according to claim 6, wherein a control time for a fuel injector is calculated from the fuel mass, and wherein the monitoring module checks the fuel mass and the control time for the fuel injector for plausibility relative to one another.

9. The device according to claim 7, wherein, to calculate the fuel mass from the setpoint torque, the control module takes correction factors into account, and the correction factors are compared to threshold values for fault detection.

10. The device according to claim 9, wherein, to calculate the instantaneous torque from the fuel mass, the correction factors are taken into account.

* * * * *